United States Patent [19]

Fenner et al.

[11] 4,232,728

[45] Nov. 11, 1980

[54] METHOD FOR ENHANCED HEAT TRANSFER

[75] Inventors: Gary W. Fenner, Grand Island; Elias G. Ragi, Williamsville, both of N.Y.

[73] Assignee: Union Carbide Corporation, New York, N.Y.

[21] Appl. No.: 15,425

[22] Filed: Feb. 26, 1979

Related U.S. Application Data

[62] Division of Ser. No. 721,861, Sep. 9, 1976, Pat. No. 4,154,293.

[51] Int. Cl.[3] ..... F28F 13/08

[52] U.S. Cl. ..... 165/1; 165/133

[58] Field of Search ..... 165/1, 133; 138/38, 138/146; 428/553, 559

[56] References Cited

U.S. PATENT DOCUMENTS

| | | | |
|---|---|---|---|
| 3,384,154 | 5/1968 | Milton | 165/133 |
| 3,622,403 | 11/1971 | French | 148/12 R |
| 3,990,862 | 11/1976 | Dahl et al. | 165/133 |
| 4,154,294 | 5/1979 | Notaro | 165/133 |

OTHER PUBLICATIONS

Dipprey et al., Heat and Momentum Transfer in Smooth and Rough Tubes, Journal of Ind. Heat and Mass Transfer, vol. 6, pp. 329–353, 1963.

Faust et al., The Electrodeposition of Porous Metal, Transactions of the Institute of Metal Finishing, No. 31, pp. 517–526, 1954.

*Primary Examiner*—Sheldon Richter

*Attorney, Agent, or Firm*—John C. LeFever; Alvin H. Fritschler

[57] ABSTRACT

An inner surface substrate of metal tubes is provided with a single layer of randomly distributed metal bodies bonded to the substrate, spaced from each other, and substantially surrounded by the substrate to form body void space.

4 Claims, 13 Drawing Figures

FIG. 2
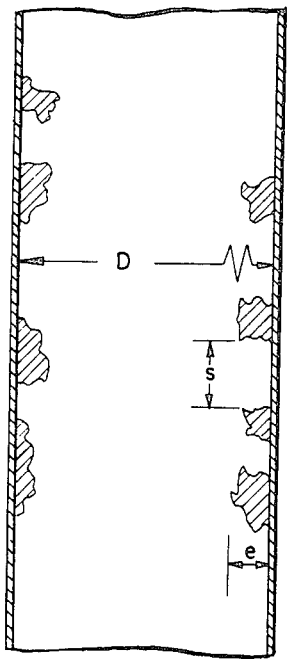
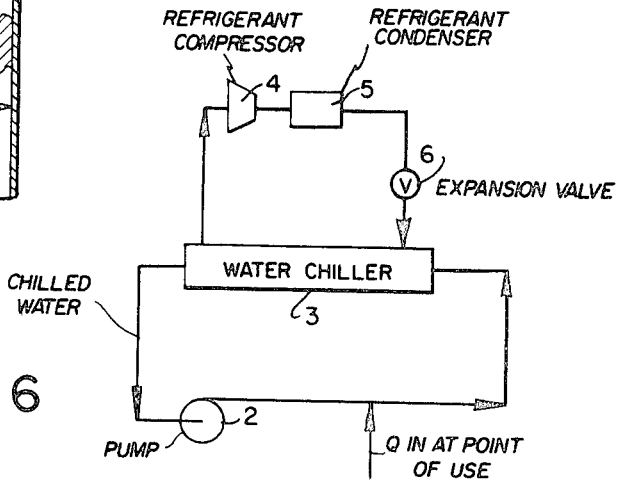
FIG. 6
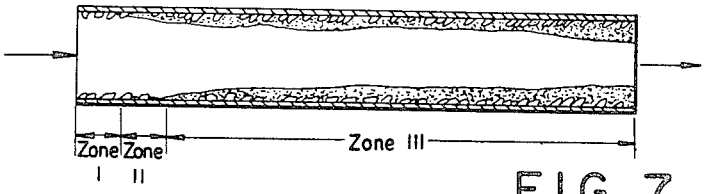
FIG. 7

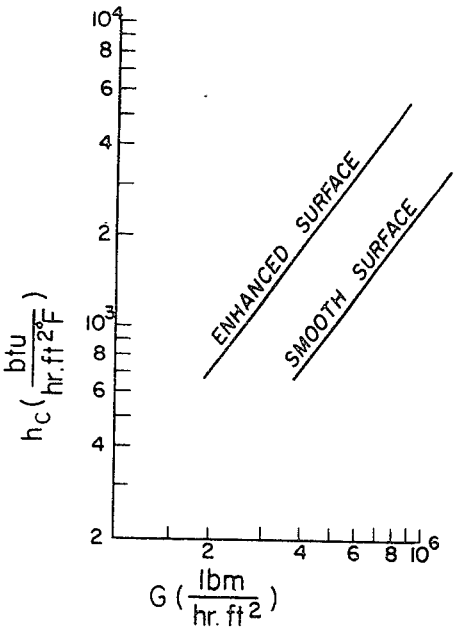
FIG. 8
FIG. 9
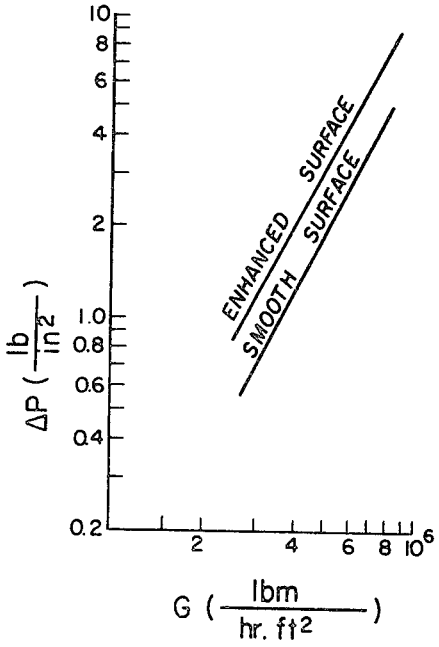

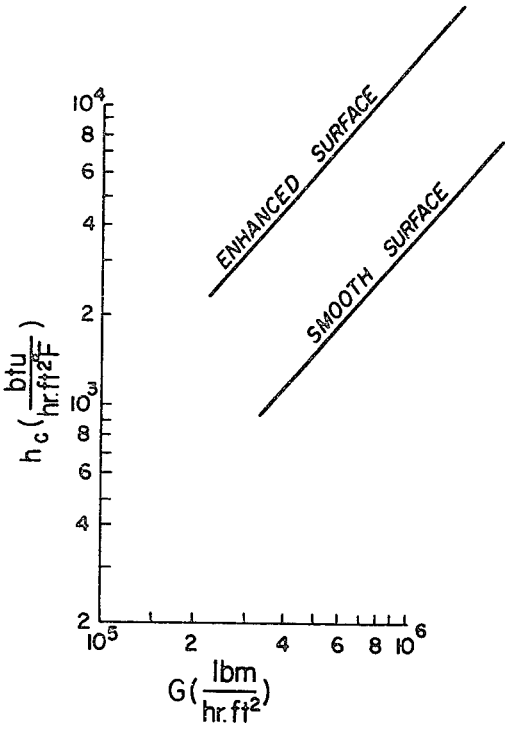
FIG. 10
FIG. 11
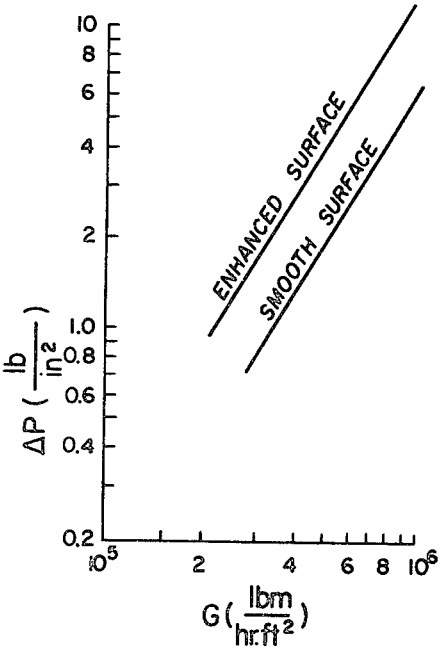

FIG. 12
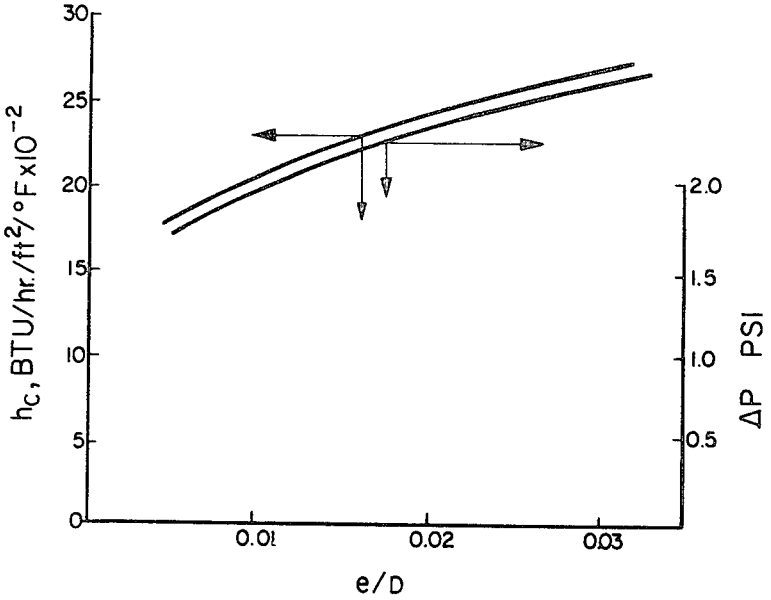
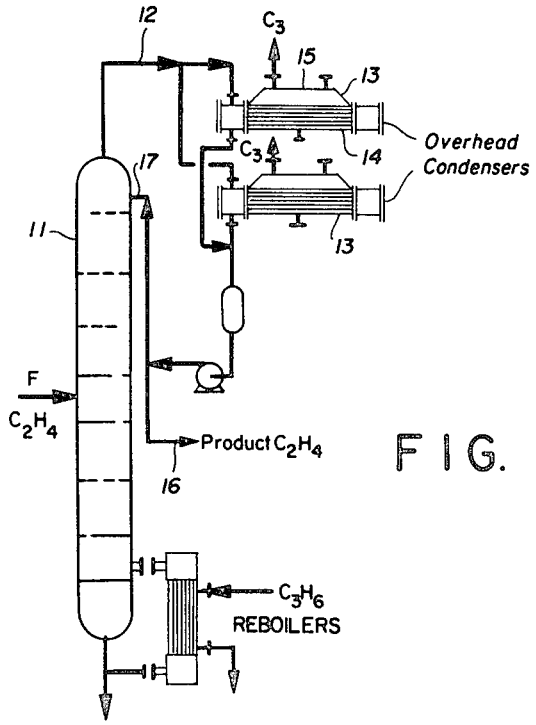
FIG. 13

METHOD FOR ENHANCED HEAT TRANSFER

This application is a division of our prior U.S. application, Ser. No. 721,861, filing date Sept. 9, 1976, which is now U.S. Pat. No. 4,154,293, issued May 15, 1979.

BACKGROUND OF THE INVENTION

This invention relates to a method for enhanced heat transfer using a metal tube with enhancement means on the inner surface substrate, an enhanced heat transfer device, and a shell and tube type heat exchanger.

In systems involving the transfer of heat across a tube wall, a variety of techniques have been devised to augment inside surface heat transfer, i.e., surface promotors which are protuberances from or indentations in the surface of the wall, displaced promotors which are bodies of streamlined shape or similar packing material inserted in the tubes, promotion of vortex flow by propellers or coil inserts, vibration, and electrostatic fields. Such techniques require energy input and the promotion of increased heat transfer at the expense of an inordinately high energy input has limited the commercial application of augmentation devices which otherwise have favorable characteristics. Therefore, the heat transfer rate improvement promoted by a specific technique is commonly analyzed on a basis which relates to the amount of energy required to achieve such promotion, thereby obtaining an indication of the cost effectiveness of the system.

Surface promotion has received the most attention by reason of its cost effectiveness, and tubing is commercially available which employs protruding fins or indented flutes which are extended either around the periphery or axially along the length of the tube. The flutes or fins can also trace a spiral path in order to create a swirl-type flow within the tube. Knurling of the surface is also practiced commercially as well as the introduction of evenly-spaced geometrically symmetric protuberances, i.e., diamond-shaped pyramids and squared blocks. The prior art reports heat transfer rate and pressure drop data for a variety of commercially available forms of surface promoters and also reports similar data for systems which, to date, have not been commercially exploited. The data indicate that the random sand grain finish produced by Dipprey & Sabersky ("Heat and Momentum Transfer in Smooth and Rough Tubes," Journal of Industrial Heat and Mass Transfer, 1963, Vol. 6, pp. 329–353) is especially efficient with respect to the degree of heat transfer rate enhancement which can be achieved per unit of energy expended. The DippreySabersky tube was fabricated by electroplating nickel over mandrels coated with closely packed, graded sand grains. The mandrels were subsequently chemically dissolved and the remaining solid nickel shell with surface indentations served as the test tube. The tube wall material was of high purity and uniform throughout, therefore, representing a heat transfer medium which was not adversely affected by voids or materials with thermal conductivity less than nickel. The reported data indicate that a homogenous nickel tube with an internal "mirror image" sand grain finish is an efficient heat transfer medium, particularly with respect to the transfer rate enhancement-energy input relationship. Accordingly, industrial exploitation of such systems would be expected; however, the expense associated with the fabrication of the Dipprey-Sabersky tube cancel the cost effectiveness which would otherwise be associated with such systems.

The performance of heat transfer enhancing surfaces, is commonly mathematically analyzed in terms of the Overall Products Ratio; $R = hfo/hof$; where $h$ = heat transfer coefficient of the altered surface
$ho$ = heat transfer coefficient of a smooth surface
$f$ = Fanning Friction Factor of the altered surface
$fo$ = Fanning Friction Factor of a smooth surface The ratio R relates the heat transfer rate improvement and the frictional fluid flow losses associated with the improvement. For example, for systems in which R is unity, the percentage increase in heat transfer rate is equal to the percentage increase in frictional losses. The prior art reports values of R approaching 1.0 for surfaces which enhance the heat transfer rate 2–3 times.

An object of this invention is to provide an enhanced heat transfer device of the metal tube type with enhancement means on the inner surface having an Overall Product Ratio R at least approaching unity which is relatively inexpensive to manufacture on a commercial mass-production basis.

Another object is to provide an enhanced heat transfer device of the internal enhancement metal tube type having on Overall Product Ratio which is appreciably higher than unity.

Still another object is to provide an improved shell-tube type heat exchanger characterized by enhanced heat transfer means on the tube inner surface under turbulent flow conditions.

A further object of this invention is to provide a method for enhanced heat transfer in a shelltube type heat exchanger wherein a first fluid flows through the tubes under turbulent flow conditions in heat exchange relation with a second fluid on the shell side.

Other objects and advantages of this invention will be apparent from the ensuing disclosure and appended claims.

SUMMARY

This invention relates to an enhanced heat transfer device using a metal tube with enhancement means on the inner surface substrate, a shell and tube type heat exchanger, and a method of enhanced heat transfer for fluids flowing through a metal tube.

In the apparatus aspect of this invention, an enhanced heat transfer device is provided comprising a metal tube having an inner surface substrate and a single layer of randomly distributed metal bodies each individually bonded to the substrate and spaced from each other and substantially surrounded by the substrate so as to form body void space. The tube effective inside diameter and body height are related to each other such that in the ratio e/D wherein e is the arithmetic average height of the bodies on the substrate and D is the effective inside diameter of the tube, e/D is at least 0.006, and the body void space is between 10 percent and 90 percent of the substrate total area. When the aforedescribed enhanced heat transfer device is used for sensible heat transfer, e/D is less than 0.02.

This invention also contemplates a heat exchanger having a multiplicity of longitudinally aligned metal tubes transversely spaced from each other and joined at opposite ends by fluid inlet and fluid discharge manifolds, and shell means surrounding said tubes having means for fluid introduction and fluid withdrawal, with each tube having an inner surface substrate and an outer surface substrate. The improvement comprises a single layer of randomly distributed metal bodies each individually bonded to the inner surface substrate, spaced from each other and substantially surrounded by the inner surface substrate so as to form body void space. The tube effective inside diameter and body height are related to each other such that in the ratio e/D wherein e is the arithmetic average height of the bodies on the inner surface substrate and D is the effective inside diameter of the tube, e/D is at least 0.006 and the body void space is between 10 percent and 90 percent of the inner surface substrate total area. A multiple layer of stacked metal particles is integrally bonded togehter and to the outer surface substrate to form interconnected pores of capillary size having an equivalent pore radius less than about 4.5 mils. The combination of this layer (for enhanced boiling heat transfer) with the metal body single layer provides matching enhanced heat transfer coefficients on each side of the metal tube wall, and a remarkable efficient heat exchanger and heat transfer method.

This invention also contemplates a method for enhancing heat transfer between a first fluid at first inlet temperature and a second fluid at a second initial temperature substantially different from said first inlet temperature in a heat exchanger wherein said first fluid is flowed through at least one metal tube in heat transfer relation with the second fluid outside said tube. A single layer of randomly distributed metal bodies is provided with each body individually bonded to the tube inner surface substrate and spaced from each other and substantially surrounded by the substrate so as to form body void space with the tube effective inside diameter and body height related to each other such that in the ratio e/D wherein e is the arithmetic average height of the bodies on the substrate and D is the effective inside diameter of the tube, e/D is at least 0.006 and the body void space is between 10 percent and 90 percent of the substrate total area. The first fluid is passed through the tube under turbulent flow conditions in at least part of the tube such that its equivalent Reynolds Number in such tube part is at least 9000.

In one preferred embodiment of the aforedescribed method for enhanced sensible heat transfer, the first fluid passes through the tube solely in the liquid phase in contact with the metal body layered surface with a heat transfer coefficient ratio to a smooth tube surface $h_s/h_o$ of at least 1.8 and Fanning Friction Factor ratio of a smooth tube inner surface to said metal body layered surface $f_s/f_o$ such that the Overall Product Ratio $h_sf_o/h_of_s$ is at least 0.95. In another preferred method for enhanced condensation heat transfer, the first fluid is at least partially condensed while passing through said tube in contact with the metal body single layered surface with a heat transfer coefficient ratio to a smooth tube surface $h_c/h_o$ of at least 2.5 Fanning Friction Factor ratio of a smooth tube inner surface to said metal body single layered surface $f_o/f_c$ such that the Overall Product Ratio $h_cf_o/h_of_c$ is at least 1.4.

In systems involving turbulent fluid flow, a laminar fluid sublayer can exist at the phase boundaries which imposes a resistance to the exchange of heat between phases. The resistance is directly proportional to the thickness of the laminar layer and in the exchange of heat between the tube wall and the flowing fluid this resistance controls the rate of heat transfer. In the transfer of sensible heat, a single laminar fluid sublayer is formed at the tube inner wall and the metal body layered surface of this invention functions as a flow-disrupting device which promotes a transition from laminar to turbulent flow behavior in the fluid sublayer, thereby reducing its depth and resistance to heat transfer.

In systems involving condensing heat transfer in which a nearly saturated vapor is introduced inside a tube to flow therethrough and be cooled by contact with the chilled tube wall, the condensing fluid flow conditions vary over the axial length of the tube as a consequence of the accumulation of condensate. It has been determined that a first condition develops at the inlet end of the enhanced heat transfer device in which the metal body layered surface is essentially absent of condensate and the major resistance to heat transfer is represented by the laminar vapor phase sublayer which forms at the inner surface substrate of the device (illustrated as Zone I in FIG. 7). A second condition develops with the formation of condensate, in which the accumulation of liquid condensate on the metal body layered surface thermally insulates that portion of the tube inner wall and the primary path of heat flux is through that portion of the metal bodies which extends above the depth of accumulated condensate (illustrated as Zone II in FIG. 7). A third condition exists in the exit section of the enhanced heat transfer device involving an accumulation of condensate to a depth which exceeds the height "e" of the metal bodies (illustrated as Zone III in FIG. 7). Two phase boundaries exist in the exit section: one is associated with the vapor liquid interface and the other is associated with the liquid-wall interface. A mathematical model has been developed to study the operating characteristics of this enhanced heat transfer device in condensing heat transfer, and the same establishes that in tubes of commercial length, i.e., greater than 5 feet, the exit section condition (Zone III) prevails in the greater portion of the tube length, and that the laminar layer of liquid which is associated with the liquid-wall interface, imposes a resistance to heat flux which controls the rate of condensation in that section.

It has been determined that in the major portion of the axial extent of the tube the resistance which controls the rate of condensing heat transfer is associated with the fluid-wall interface, so the single layer body-metal body surface is effective for enhancing the heat transfer in said major portion. Accordingly, sensible heat transfer and internal condensing heat transfer share a common mechanism involves the creation of turbulence in the otherwise laminar fluid sublayer which exists at the tube inner wall.

In turbulent fluid flow, the pressure reduction experienced by the fluid is related to the shear stresses created at the phase boundaries. In sensible heat transfer, a single such phase boundary exists at the tube inner wall. The very turbulence which the instant metal body layered surface promotes to enhance heat transfer unfortunately also increases the shear stresses which are active along the phase boundary, thereby increasing the pressure drop experienced by the fluid. However, condensing heat transfer operations involve the two phase boundaries described above; one is associated with the vapor-liquid interface and the other with the liquid-wall interface. Shear stresses are operative at each of the phase boundaries and the total energy loss is the sum of the separate losses encountered at each of the phase boundaries. It has been determined that the enhanced heat transfer device of this invention does not significantly affect the flow conditions at the vaporliquid interface and the energy losses associated therewith. Accordingly, the undesired but unavoidable fractional increase in fluid pressure drop (relative to smooth inner-walled tube performance) which is encountered in the practice of this invention is of greater consequence in sensible heat transfer.

In the practice of this invention, the determination of the body void space is made by magnifying a planar view of the enhanced surface and visually counting the number of metal bodies per unit of substrate area. The area occupied by a metal body is directly related to the dimensions of the metal body and the visual count provides a means of determining the area occupied by the metal bodies per unit of substrate area. The void space of the enhanced surface is the unoccupied area and herein is expressed as a percent of the substrate area.

As will be described hereinafter in connection with preparation of enhanced heat transfer devices for sensible and condensing heat transfer experiments, the metal bodies may, for example, comprise a mixture of copper as the major component and phosphorous (a brazing alloy ingredient) as a minor component. In another commercially useful embodiment, the metal bodies may comprise a mixture of iron as the major component, and phosphorous and nickel (the latter for corrosion resistance) as minor components.

IN THE DRAWINGS

FIG. 2 is a schematic elevation view of an enhanced heat transfer device according to the invention taken in cross-section.

FIG. 6 is a schematic flow diagram of a water chiller system employing the enhanced heat transfer device of this invention for sensible heat transfer.

FIG. 7 is a schematic elevation view of an enhanced condensation heat transfer device showing three distinct zones.

FIG. 8 is a graph of condensing heat transfer coefficient vs. Refrigerant-12 flow rate for low exit quality partially condensed product using the enhanced heat transfer device and a smooth inner surface metal tube.

FIG. 9 is a graph of pressure drop vs. Refrigerant-12 flow rate for low exit quality partially condensed product using the enhanced heat transfer device and a smooth inner surface metal tube for condensation.

FIG. 10 is a graph of condensing heat transfer coefficient vs. Refrigerant-12 flow rate for high exit quality partially condensed product using the enhanced heat transfer device and a smooth inner surface metal tube.

FIG. 11 is a graph of pressure drop vs. Refrigerant-12 flow rate for high exit quality partially condensed product using the enhanced heat transfer device and a smooth inner surface metal tube for condensation.

FIG. 12 is a graph of condensation heat transfer coefficient and pressure drop for Refrigerant-12 vs. e/D for a 10 ft. tube at a heat flux Q/A of 20,000 BTU/hr. $ft^2$.

FIG. 13 is a schematic flow diagram of an ethylene-higher hydrocarbon separation system employing the enhanced heat transfer device of this invention for condensation heat transfer.

DETAILED DESCRIPTION

Figure 1:
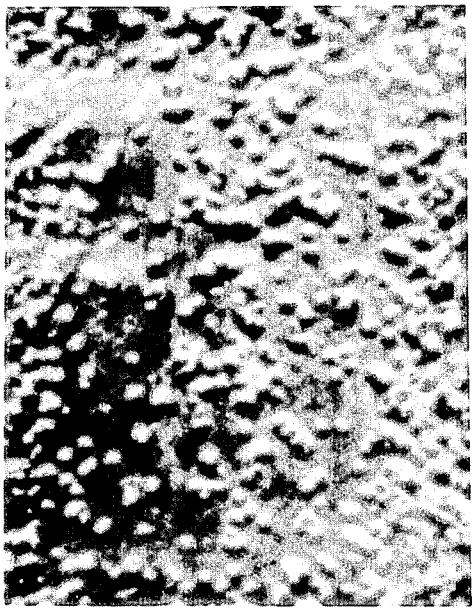
FIG. 1 is a photomicrograph plan view looking downwardly on a single layer of randomly distributed metal bodies each bonded to a tubular substrate (10X magnification).

FIG. 1 is a photomicrograph of a single layer of randomly distributed metal bodies each bonded to a tubular substrate. This single layer surface was prepared by first screening copper powder to obtain a graded cut, i.e., through 60 and retained on 100 U.S. Standard mesh screen, and dry-mixed with −325 mesh phos-copper brazing alloy of 92 percent copper −8 percent phosphorous by weight. The dry-mix was formulated in the ratio of 4 parts by weight copper to one part phos-copper. The dry mix was subsequently slurried in a solution of 6 percent by weight polyisobutylene in herosene. The resulting mixture was exposed to the atmosphere at room temperature thereby allowing the kerosene to evaporate. So treated, the particles of phos-copper brazing alloy was evenly disposed on and secured by the polisobutylene coating to the surface of the copper particles. The powder was dry to the touch and free-flowing. A copper tube with 0.679 inch I.D. and 0.75 inch O.D. was coated with a 10 percent polyisobutylene in kerosene solution by filling the tube with the solution followed by draining same from the tube. Next, the pre-coated particles were poured through the tube thereby coating the internal inner surface substrate with pre-coated particles. The tube was furnaced at 1600° F. for 15 minutes in an atmosphere of disassociated ammonia, cooled and then tested for heat transfer and fluid flow friction characteristics as an enhanced heat transfer device. It should be noted that the randomly distributed metal bodies may comprise a multiplicity of particles bonded to each other or a single relatively large particle. This pre-coating method is not my invention but that of Robert C. Borchert and claimed in his co-pending patent application filed on even date with this application.

The aforedescribed enhanced heat transfer device may be characterized in terms of the ratio e/D wherein e is the arithmetic average height of the bodies on the tube inner surface substrate and D is the effective inside diameter of the tube. It is also characterized by the body void space percentage of the substrate total area, i.e. the percentage of the substrate total area not covered by the base of the bodies. These characterizations are illustrated in the FIG. 2 schematic elevation view with "S" representing part of the body void space. On the basis of these characterizations the aforedescribed test device has an e value of 0.0084 inches, a D value of 0.679 inches, and a body void space of about 50 percent of the substrate total area.

FIG. 6 is a schematic flow diagram of the test water chiller system used to demonstrate the heat transfer and friction flow characteristics of the aforedescribed enhanced heat transfer device, and also represents a typical potential commercial use of same. Water is heated by indirect heat exchange with steam in a heat exchanger identified as "Q" and pumped by water pump 2 into water chiller 3 where it is cooled by heat exchange with boiling refrigerant R-22. The vaporized refrigerant R-22 discharged from water chiller 3 is repressurized in compressor 4, condensed by heat exchange with cooling water in condenser 5, expanded through valve 6 and returned to the water chiller 3. Pressure drop-flow rate relationships were measured for the enhanced heat transfer device and the same size tube without the metal body layered surface on the inner wall, i.e. a smooth wall. In each instance the external surface of the tube was coated with a multiple layer of stacked copper particles integrally bonded together to form interconnected pores of capillary size in manner described in U.S. Patent No. 3,384,154 to R. R. Milton (porous boiling layer).

Figure 4:
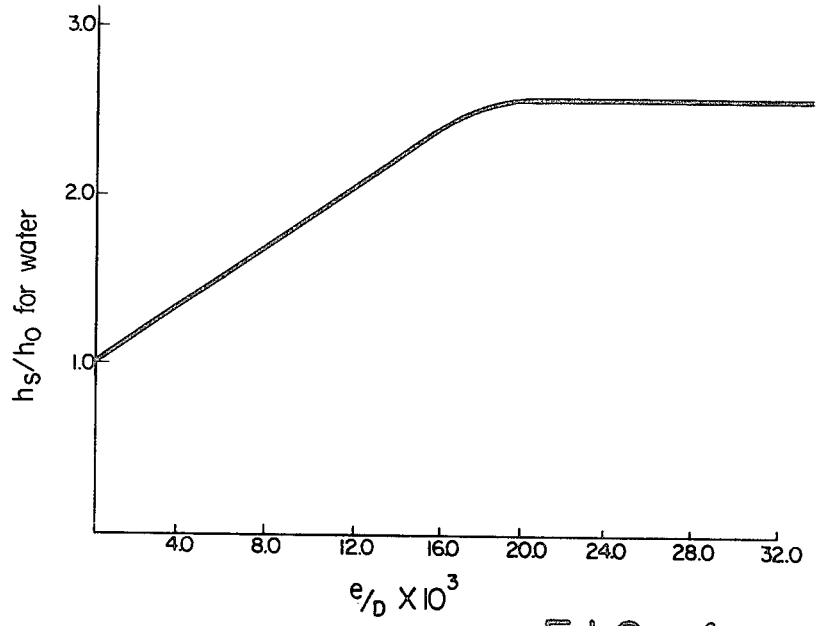
FIG. 4 is a graph of heat transfer coefficient ratio $h_s/h_o$ vs. $e/D \times 10^3$ for sensible heat transfer for water.

The sensible heat transfer enhancement of the aforedescribed test device and other similar devices prepared by the aforedescribed pre-coating method is illustrated in FIG. 4.

All of the enhanced heat transfer devices used in the tests summarized by the FIGS. 4 and 5 graphs were identical to the previously described device with the exception of metal body height e values as follows: 3, 5, 6.5, 8.4, 10.8, 14.1, 19.9, all times $10^{-3}$ inches. The FIG. 4 graph shows that the sensible heat transfer rate enhancement provided by the devices of this invention increases with e/D up to a value of about 0.02 and then $h_s/h_o$ becomes constant at about 2.5 with further increases in e/D. The heat transfer enhancement is achieved at the expense of increased energy input since the turbulence acts to increase the Fanning Friction Factor, and increased energy input is required to pump the fluid through the tube. The ratio h/f is a convenient means of analyzing the value of an enhanced heat transfer device and such ratio for an enhanced surface $h_s/f_s$ (where s refers to sensible heat transfer) or $h_c/f_c$ (where c refers to condensing heat transfer) each divided by such ratio for a smooth surface $h_o/f_o$ indicates whether a disproportional energy input is required to achieve an improved heat transfer rate. Devices which exhibit $hf_o/h_of$ Overall Product Ratios of at least unity enhance the heat transfer rate by a factor which is at least equal to the concomitant increase in the resistance to fluid flow.

Figure 5:
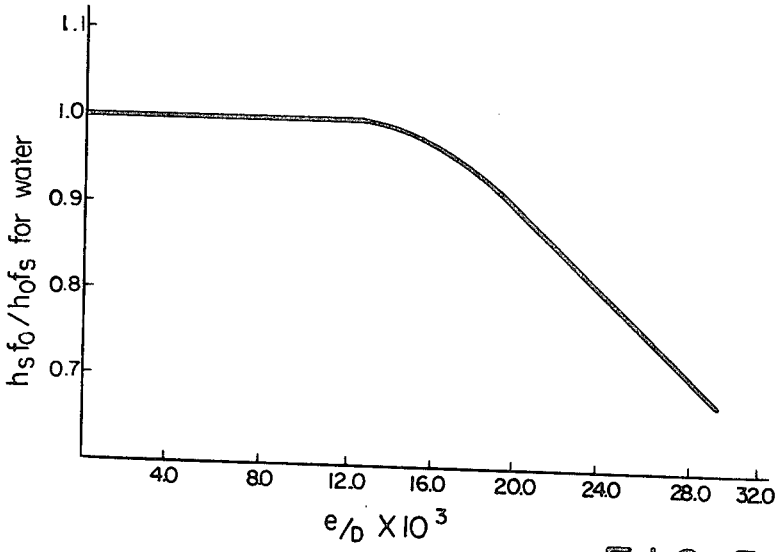
FIG. 5 is a graph of Product Ratio $h_s f_o/h_o f_s$ vs. $e/D \times 10^3$ for sensible heat transfer for water.

In the practice of this invention, e/D ratios of at least 0.006 are required to achieve sufficient heat transfer enhancement to justify the increased friction, and for sensible heat transfer as illustrated in FIGS. 4 and 5, e/D should not exceed 0.02 as no further improvement in heat transfer coefficient is achieved at higher values. FIG. 5 shows that due to the increasing Fanning Friction Factor, the Overall Product Ratio $h_sf_o/h_of_s$ decreases approximately linearly above e/D ratio of about $12\times10^{-3}$.

In practicing the method of this invention, fluid is passed through the tube under turbulent flow conditions in at least part of said tube such that is Equivalent Reynolds Number in such tube part is at least 9000. As used herein, "Equivalent Reynolds Number" is based on the procedure outlined in Ikers, W. W., Rosson, H. F., Chem. Eng. Prog., Symp. Ser. 56, No. 30, pp. 145–149 (1959) only when two-phase (gas and liquid) flow through the tube occurs. Where there is only single-phase flow, Equivalent Reynolds Number is the same as the conventional Reynolds Number so that for sensible heat transfer, as for example practiced in the tests summarized by the FIGS. 4 and 5 data, the conventional method is used to calculate the Reynolds Number. Unless the Equivalent Reynolds Number is at least 9000, turbulent flow does not exist in the tube along with the characteristic laminar film which is disrupted by the metal body layered surface of this invention. In the aforedescribed tests, the Equivalent Reynolds Numbers were in the range of 18,000 to 65,000.

It should also be noted that this invention is not limited to tubes of circular cross-section but contemplates the use of non-circular cross-section, as for example oval configuration, by the identification of D as the effective inside diameter of the tube. As used herein, "effective inside diameter" is four times the hydraulic radius of the tube, as for example described in Perry's Chemical Engineers Handbook, pg. 107, Second Edition, (published in 1941).

As previously stated, in the practice of this invention, the body void space is between 10 percent and 90 percent of the substrate total area and preferably between 30 percent and 80 percent. In the aforedescribed tests, all enhanced heat transfer devices were characterized by a body void space of about 50 percent. In other tests, slightly lower but still acceptable sensible heat transfer coefficients were obtained with enhanced heat transfer devices having about 80 percent void space, and it appears that substantial heat transfer enhancement would be realized with void spaces up to about 90 percent of the substrate total area. It should be recognized that with fewer metal bodies per unit area, the Fanning Friction Factor desirably decreases. On the other hand, tests have indicated that with 20 percent void space, the sensible heat transfer coefficient is substantially the same as with 50 percent void space, however, the Fanning Friction Factor increases substantially. The aforedescribed sensible heat transfer tests illustrate a preferred method for enhanced heat transfer according to this invention wherein the first fluid passes through the tube solely in the liquid phase in contact with the metal body layered surface. In this method the first fluid and the second fluid are contacted at conditions (temperatures, pressures and flow rates) such that the first fluid heat transfer coefficient ratio to a smooth tube surface $h_s/h_o$ is at least 1.8 and the Fanning Friction Factor ratio of a smooth tube inner surface to the metal body single layered surface $f_o/f_s$ is such that the Overall Product Ratio $h_sf_o/h_of_s$ is at least 0.95. Accordingly, it appears that the increased pressure drop experienced at body void spaces below 10 percent of the substrate total area cannot be justified. In the aforedescribed precoating method for preparing the enhanced heat transfer device, the metal powder was prepared by screening to obtain the desired body height, e. In particular, it was found that the arithmetic average of the smallest screen opening through which the particles passed and the largest screen opening on which such particles are retained is equivalent to e. These relationships are set forth in the following Table A:

TABLE A

| U.S. Standard Screen Mesh | Opening (inches) | e inches |
|---|---|---|
| 270 | 0.0021 | |
| 230 | 0.0024 | |
| 170 | 0.0035 | 0.003 (thru 170 on 230 mesh) |
| 120 | 0.0049 | |
| 100 | 0.0059 | 0.054 (thru 100 on 120 mesh) |
| 80 | 0.007 | 0.0065 (thru 80 on 100 mesh) |
| 60 | 0.0098 | 0.0084 (thru 60 on 80 mesh) |
| 50 | 0.0117 | 0.0108 (thru 50 on 60 mesh) |
| 40 | 0.0165 | 0.0141 (thru 40 on 50 mesh) |
| 30 | 0.0232 | 0.0199 (thru 30 on 40 mesh) |
| 20 | 0.0331 | |

Figure 3:
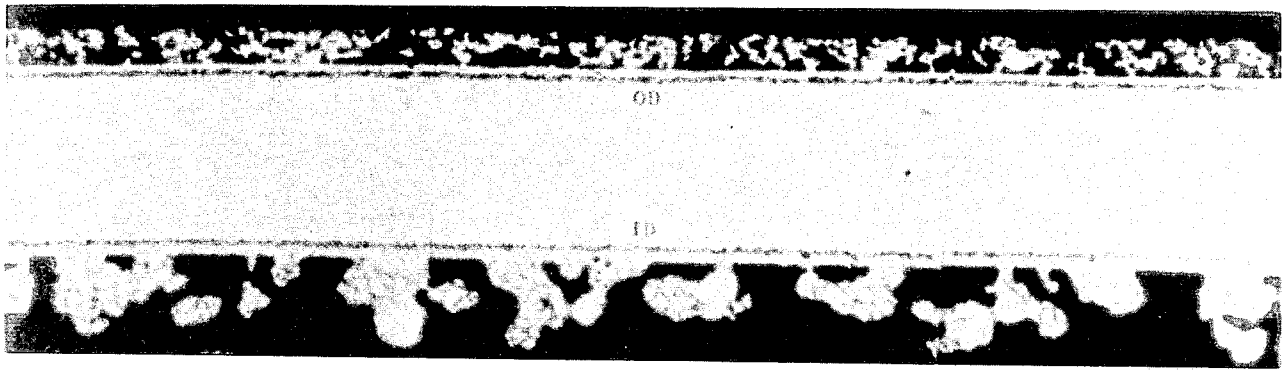
FIG. 3 is a photomicrograph elevation view of an enhanced heat transfer device with the single layer of metal bodies bonded to the inner surface substrate and a porous boiling layer of stacked metal particles bonded to the outer surface (50X magnification).

It is important to understand that the single layered metal body surface of this invention is quite different from the aforementioned multi-layered porous boiling surface in which metal particles are stacked and integrally bonded together and to a substrate to form interconnected pores of capillary size. This difference is illustrated in the FIG. 3 photomicrograph and the performance demonstrated by a series of tests in which 0.679 inches I.D. copper tubes were internally coated with a single layer and multi-particle layers of copper powder of various particle size ranges. These internally coated tubes were tested in the FIG. 6 water chiller system using water as the fluid sensible heat transferring fluid circulating through the tube at an effective Reynolds Number of 35,000 and Prandlt Number of 10.0. The results of these tests are summarized in Table B as follows:

TABLE B

| Tube No. | Particle Size (screen mesh) | e/D | $h_s/h_o$ | $f_s/f_o$ | Overall Product Ratio | Number Layers |
|---|---|---|---|---|---|---|
| 1 | −325 | <0.0029 | 1.05 | 1.42 | .74 | multi |
| 2 | 170/230 | 0.0044 | 1.23 | 1.23 | 1.00 | single |
| 3 | 60/80 | 0.012 | 2.1 | 2.70 | 0.78 | multi |
| 4 | 60/80 | 0.92 | 2.05 | 1.96 | 1.05 | single |
| 5 | 40/50 | 0.021 | 2.46 | 2.97 | 0.83 | single |

It may be concluded from Table B that Tube No. 1 characterized by relatively fine particles in multi-layer form is unsuitable for practice of this invention since both the sensible heat transfer improvement and Overall Product Ratio are relatively low. Tube No. 2 does not represent an embodiment of the invention since the e/D 0.0044 is below the lower limit of 0.006. It is significant that the sensible heat transfer enhancement represented by the ratio of 1.23 is relatively low and substantially equal to the Fanning Friction Factor Ratio in this single layer of metal bodies. Tube No. 3 is similar to Tube No. 1 in the sense that it is characterized as a multi-layer of stacked metal particles but the same are relatively coarse such that the e/D is 0.012. Although the sensible heat transfer enhancement ratio of 2.1 is reasonably high, the Fanning Friction Factor Ratio of 2.7 is even higher so that the Overall Product Ratio is unacceptably low for the practice of this invention. Tube Nos. 1 and 3 illustrate that multi-layers of metal particles in a porous surface type configuration provide reasonably high sensible heat transfer enhancement but are penalized by substantially higher fluid flow energy losses due to friction in contrast to the single layer of spaced metal bodies employed in this invention.

Tube No. 4 is a single layer of spaced metal bodies having the same e/D as the multi-body layer Tube No. 3. Table B shows that its sensible heat transfer enhancement ratio is about the same as Tube No. 3 but the Fanning Friction Factor Ratio is substantially lower such that the Overall Product Ratio is slightly greater than unity. For most applications of this invention, Tube No. 4 represents a preferred balance between enhanced sensible heat transfer with limited penalty for increased fluid friction. If a particular need exists for maximum sensible heat transfer enhancement a slightly coarser particle cut should be used as represented by Tube No. 5 formed from particles providing an e/D of 0.021 and a sensible heat transfer enhancement ratio of 2.46. It will be noted that the Fanning Friction Factor Ratio is significantly higher for Tube No. 5 than Tube No. 4 such that the Overall Product Ratio has diminished 0.83.

The previous discussion of Tube No. 5 can be generalized in connection with FIGS. 4 and 5. Based on FIG. 5 alone, one might conclude that there is no advantage to the employment of the aforedescribed heat transfer devices with e/D ratios exceeding about 0.012 since the Overall Product Ratio diminishes below unity. However, FIG. 4 shows that the sensible heat transfer enhancement ratio continues to increase substantially linearly up to an e/D of about 0.020 so that in some applications the length of tube required to transfer a specific quantity of heat is reduced substantially, e.g. to less than one-half that required with smooth inner surface tubes. This employment can be obtained with a moderate increase in pumping power as reflected by higher Fanning Friction Factor Ratio.

For the enhanced sensible heat transfer device, heat exchanger and method of this invention, it is preferred to form the metal bodies from particles the major portion of which pass through 60 mesh U.S. Standard screen and are retained on 80 mesh U.S. Standard screen. Table A shows this screen particle sizing provides metal bodies with an arithmetic average height e of about 0.0084 inch. It is also preferred to use metal tubes having an effective inside diameter D between 0.5 inch and 1.2 inch. The reason for these preferences is their effects (as reflected in e/D) on $h_s$ and $f_s$ as for example illustrated in FIGS. 4 and 5 and previously discussed.

As previously discussed, FIG. 7 illustrates the three zones which may exist in an enhanced heat transfer device used for at least partial condensation of a fluid passing through the device. It should be noted that enhanced condensation heat transfer probably only occurs in the length of the tube in which the metal bodies are at least partially exposed to the turbulently flowing fluid. It has also previously been indicated that the condensation embodiment of this invention is not as sensitive to fluid pressure drop increase as the sensible heat transfer embodiment. In general, it has been determined that the invention provides condensation heat transfer coefficients 3–4 times that obtained with a smooth inner wall tube and that unexpectedly, the expenditure of energy required to obtain the improved performance is less than that predicted by the prior art. By way of illustration, it has been observed that the enhanced condensation heat transfer ratio $h_c/h_o$ is greater than 1.5 times the Fanning Friction Factor $f_c/f_o$.

In another series of experiments, an enhanced heat transfer tube to be used for condensation heat transfer tests was prepared by the general procedure previously outlined in connection with the preparation of the sensible heat transfer device. However, the copper powder was through 30 to 40 mesh screen and the phos-copper precoated particles were bonded as metal bodies on the inner surface substrate of a 10 ft. long copper tube of 0.572 inch I.D. The resulting enhanced heat transfer tube had an e/D ratio of 0.031 and 50 percent body void space.

The so-prepared tube was tested in a Refrigerant-12 system for both condensation heat transfer and Fanning Friction Factor characteristics and compared with a smooth tube used for Refrigerant-12 condensation under identical conditions. The results of these tests are summarized in the FIGS. 8, 9, 10 and 11 graphs. FIGS. 8 and 9 are for operating conditions with relatively high percent condensation of feed fluid, i.e. exit quality 25–60 percent and FIGS. 10 and 11 are for conditions with relatively low percent condensation, i.e. exit quality 60–90 percent. The condensation heat transfer enhancement ratio $h_c/h_o$ was 2.4 for the low and 4.0 for the high exit quality conditions. FIGS. 9 and 11 show that the pressure drop encountered by the fluid in its passage through the enhanced heat transfer tube increased, relative to the pressure drop encountered in the smooth tube, only 68 percent and 105 percent respectively, for the low and high exit quality conditions. Accordingly, the overall product ratios were 1.43 for the low exit quality (high percent condensation) conditions and 1.95 for the high exit quality (low percent condensation) conditions.

A mathematical model was developed to predict condensation heat transfer coefficients and Fanning Friction Factors for various operating conditions and fluids and compared with the aforedescribed experimental results. It was determined that the deviation between predicted and measured rates was relatively small, and FIG. 12 reflects a generalized relationship for condensation heat transfer coefficient and increased pressure drop as functions of e/D with Refrigerant-12 in 10 ft. tube length and a heat flux Q/A of 20,000 BTU/hr-ft$^2$. FIG. 12 shows that the pressure drop increases at about the same rate as the condensation heat transfer coefficient, and this relationship exists for all applications of the invention when used for enhanced condensation heat transfer.

FIG. 13 illustrates a potential commercial application of this invention for condensation heat transfer wherein an ethylene-higher weight hydrocarbon stream and ethylene is fed to multistage fractionator 11, and ethylene is withdrawn as the overhead product through conduit 12. The latter is totally condensed in a bank of heat exchangers 13 by flow through horizontal tubes 14 in heat exchange with propylene surrounding the tubes in a shell 15. The condensed ethylene is partially withdrawn through conduit 16 as product and the remainder returned to the fractionator 11 top through conduit 17 as reflux.

For the enhanced condensing heat transfer device, heat exchanger and method of this invention, it is preferred to form the metal bodies from particles the major portion of which pass through 30 mesh U.S. Standard screen and are retained on 60 mesh U.S. Standard screen. Table A shows that this screen particle sizing provides metal bodies with an arithmetic average height e of about 0.0165 inch. The screen for this preference is the effect of height e on $h_c$ and $\Delta P$ as for example illustrated in FIG. 12.

The aforedescribed condensation heat transfer tests illustrate a preferred method for enhanced heat transfer according to this invention wherein the first fluid is at least partially condensed while passing through the tube in contact with the metal body single layered surface. In this method the first fluid and second fluid are contacted as conditions (temperatures, pressures and flow rates) such that the first fluid heat transfer coefficient ratio to a smooth tube surface ($h_c/h_o$) is at least 2.5 and the Fanning Friction Factor ratio of a smooth tube inner surface to said metal body single layered surface $f_o/f_c$ is such that the Overall Product Ratio $h_cf_o/h_of_c$ is at least 1.4.

Although particular embodiments of the invention have been described in detail, it will be understood by those skilled in the heat transfer art that certain features may be practiced without others and that modifications are contemplated, all within the scope of the claims.

What is claimed is:

1. A method for enhanced heat transfer between a first fluid at first inlet temperature and a second fluid at second initial temperature substantially different from said first inlet temperature in a heat exchanger wherein said first fluid is flowed through at least one metal tube in heat transfer relation with said second fluid outside said tube, comprising the steps of: providing a single layer of randomly distributed metal bodies each individually bonded to the tube inner surface substrate spaced from each other and substantially surrounded by said substrate so as to form body void space with the tube effective inside diameter and body height related to each other such that in the ratio e/D, wherein e is the arithmetic average height of said bodies on said substrate and D is the effective inside diameter of the tube, e/D is at least 0.006, and the body void space is between 10 percent and 90 percent of the substrate total area; and passing said first fluid through said tube under turbulent flow conditions in at least part of said tube such that its Equivalent Reynolds Number in such tube part is at least 9,000.

2. A method for enhanced heat transfer according to claim 1 wherein a multiple layer of stacked metal particles is integrally bonded together and to the tube outer surface substrate to form interconnected pores of capillary size having an equivalent pore radius less than 4.5 mils, the first inlet temperature is higher than the second initial temperature of said second fluid which is substantially liquid and is heated to its boiling point and boiled during said heat transfer.

3. A method for enhanced heat transfer according to claim 1 wherein said first fluid passes through said tube solely in the liquid phase in contact with the metal body layered surface with a heat transfer coefficient ratio to a smooth tube surface $h_s/h_o$ of at least 1.8 and the Fanning Friction Factor ratio of a smooth tube inner surface to said metal body layered surface $f_o/f_s$ is such that the Overall Product Ratio $h_sf_o/h_of_s$ is at least 0.95.

4. A method for enhanced heat transfer according to claim 1 wherein said first fluid is at least partially condensed while passing through said tube in contact with the metal body layered surface with a heat transfer coefficient ratio to a smooth tube surface $h_c/h_o$ of at least 2.5 and the Fanning Friction Factor ratio of a smooth tube inner surface to said metal body layered surface $f_o/f_c$ such that the Overall Product Ratio $h_cf_o/h_of_c$ is at least 1.4.

* * * * *